US008474639B2

(12) United States Patent
Pinder

(10) Patent No.: US 8,474,639 B2
(45) Date of Patent: Jul. 2, 2013

(54) COLLAPSIBLE CONTAINER

(75) Inventor: Anthony Ian Pinder, London (GB)

(73) Assignee: Christopher Bibby and Trent Scanlan, Kent (GB)

( * ) Notice: Subject to any disclaimer, the term of this patent is extended or adjusted under 35 U.S.C. 154(b) by 205 days.

(21) Appl. No.: 12/579,053

(22) Filed: Oct. 14, 2009

(65) Prior Publication Data

US 2011/0084082 A1 Apr. 14, 2011

(51) Int. Cl.
*B65D 90/12* (2006.01)
*A45C 13/04* (2006.01)

(52) U.S. Cl.
USPC ..... 220/9.2; 220/630; 220/628; 220/626

(58) Field of Classification Search
USPC ..... 220/9.3, 9.2, 9.4, 9.1, 495.11, 495.08, 220/495.06, 666, 23.86, FOR. 116, FOR. 112, 220/7, 6, 630, 628, 626; 493/311, 310, 309, 493/137, 136, 121, 267
IPC ..... B65D 6/18,25/14, 90/12; A45C 13/04
See application file for complete search history.

(56) References Cited

U.S. PATENT DOCUMENTS

| | | | | | |
|---|---|---|---|---|---|
| 1,955,385 | A | * | 4/1934 | Gray | 220/495.11 |
| 2,173,970 | A | * | 9/1939 | Lagerholm | 220/615 |
| 2,364,012 | A | * | 11/1944 | Walton et al. | 229/117.28 |
| 3,484,017 | A | * | 12/1969 | O'Donnell | 229/117.33 |
| 3,938,728 | A | * | 2/1976 | Deards et al. | 229/117.33 |
| 4,338,979 | A | * | 7/1982 | Dow | 141/10 |
| 5,403,634 | A | | 4/1995 | Mauffette | |
| 5,947,312 | A | * | 9/1999 | Elstone | 220/1.5 |
| 6,061,955 | A | | 5/2000 | Domstein | |

FOREIGN PATENT DOCUMENTS

| | | | |
|---|---|---|---|
| DE | 88 09 442 | U1 | 12/1988 |
| DE | 299 14 809 | U1 | 12/1999 |
| EP | 0 163 453 | A1 | 12/1985 |
| EP | 0 394 595 | A1 | 10/1990 |
| FR | 2 413 273 | A1 | 7/1979 |
| GB | 2 037 711 | A | 7/1980 |
| JP | 2006326280 | A | 12/2006 |
| WO | WO 04/000528 | A2 | 12/2003 |

OTHER PUBLICATIONS

Translation of Chuchana (FR 2413273), Jul. 27, 1979, p. 2 lines 11-25.*
Translation of Nelson (EP 394595), Oct. 31, 1990, p. 2 lines 13-19.*
Translation of Chuchana (FR 2413273), Jul. 27, 1979.*
Translation of Takeshi et al. (JP 2006-326280), Dec. 7, 2006.*
EP 09 16 7652 Search Report, mailed Jan. 15, 2010.

* cited by examiner

*Primary Examiner* — Mickey Yu
*Assistant Examiner* — Robert J Hicks
(74) *Attorney, Agent, or Firm* — Fay Sharpe LLP

(57) ABSTRACT

A collapsible vase has a sleeve having an open state in which at least one item can be placed in the sleeve and a flattened state for storage during non-use of the vase. The sleeve has a flap at one end of each side panel of the sleeve. The vase also has a base with slots arranged to securely receive respective flaps when the sleeve is in its open state, whereby the sleeve is retained by the base in a substantially upright position.

9 Claims, 2 Drawing Sheets

COLLAPSIBLE CONTAINER

FIELD OF THE INVENTION

The present invention relates to a collapsible container and more particularly to a collapsible vase.

BACKGROUND OF THE INVENTION

WO 2004/000528 discloses a plastic vase having a collapsible molded container, a molded rim, and a molded base. The container has four walls with a membrane hinge running between adjacent walls. A pair of opposing walls of the container also has a membrane hinge running along the length of each wall dividing it into two halves. Each wall of the container also has a hinged flap at its base which folds inwards to form the base of the container. The molded vase base has a raised rim inside of which the container is clipped. The molded vase rim is clipped to the top of the container to hold it open.

A problem with this plastic vase is that when the vase has been erected by having the container has been clipped into its base and the rim clipped to the top of the container, the erected vase is not that stable as it can be easily knocked over. The vase is complex and not that cheap to make and it also has the problem of not being easily disposable.

It is an object of the present invention to provide a collapsible container to alleviate the above-mentioned problems.

SUMMARY OF THE INVENTION

According to one aspect of the present invention there is provided a collapsible container, comprising:

a sleeve having first and second ends and at least one projection extending from said first end, the sleeve having an open state in which at least one item can be placed in the sleeve and a flattened state for storage during non-use of the container; and a base having at least one opening for securely receiving at least one said projection when the sleeve is in its open state, whereby said sleeve is retained by said base in a substantially upright position.

The container is simple and cheap to make and can comprise disposable material such as cardboard which is biodegrade and it can also be readily recycled.

The projection may comprise a flap adapted to be folded underneath at least an upper portion of the base when the flap is inserted into the opening. The base may have at least one region for receiving at least one said flap within the base when said at least one flap is folded underneath at least the upper portion of the base. The region is preferably arranged to receive at least one said flap folded away from the sleeve. The region may be a recess and there is preferably the same number of recesses as flaps. There is preferably the same number of openings as flaps with each flap being arranged to be inserted into a respective said opening.

A sleeve stabilising insert may be provided for insertion into the sleeve in its open state, the sleeve stabilising insert being shaped to fit closely to the inside of the sleeve in its open state.

The sleeve may have an even number of side panels interconnected by hinge lines extending longitudinally from said first end to said second end of the sleeve enabling the sleeve to be collapsed to the flattened state.

The collapsible container may include a waterproof liner for the sleeve. The waterproof liner may be removable from the sleeve. The waterproof liner may be arranged to be held in the sleeve when the sleeve is in its open state and the waterproof liner may provide more stability to the container particularly when the liner is containing liquid. The waterproof liner may comprise a supporting sleeve having first and second ends, and flexible lining means supported by the supporting sleeve. The supporting sleeve may provide more stability to the container. The supporting sleeve may have an open state in which the supporting sleeve is arranged to fit closely to the inside of the sleeve of the collapsible container in its opened state, and a flattened state for storage. The supporting sleeve may have flaps extending from said first end of the supporting sleeve, the flaps being arranged to be secured together so as to hold the supporting sleeve in an open state. The supporting sleeve may have an outer surface, the second end of the supporting sleeve forming a rim, and said flexible lining means extending over said rim and being secured to said outer surface.

According to another aspect of the present invention there is provided a collapsible container, comprising:

(a) a sleeve including:

first and second ends;

a plurality of side panels interconnected by hinge lines extending longitudinally from said first end to said second end, whereby movement of said side panels relative to each other enables the sleeve to adopt one of an open state in which at least one item can be placed in the sleeve and a flattened state for storage during non-use of the container; and at least one projection extending from said first end; and (b) a base including:

an upper surface; and at least one opening for securely receiving said at least one projection when said sleeve is in said open state, whereby said sleeve is supported in a generally upright position on said upper surface.

DESCRIPTION OF THE PREFERRED EMBODIMENT

Figure 1:
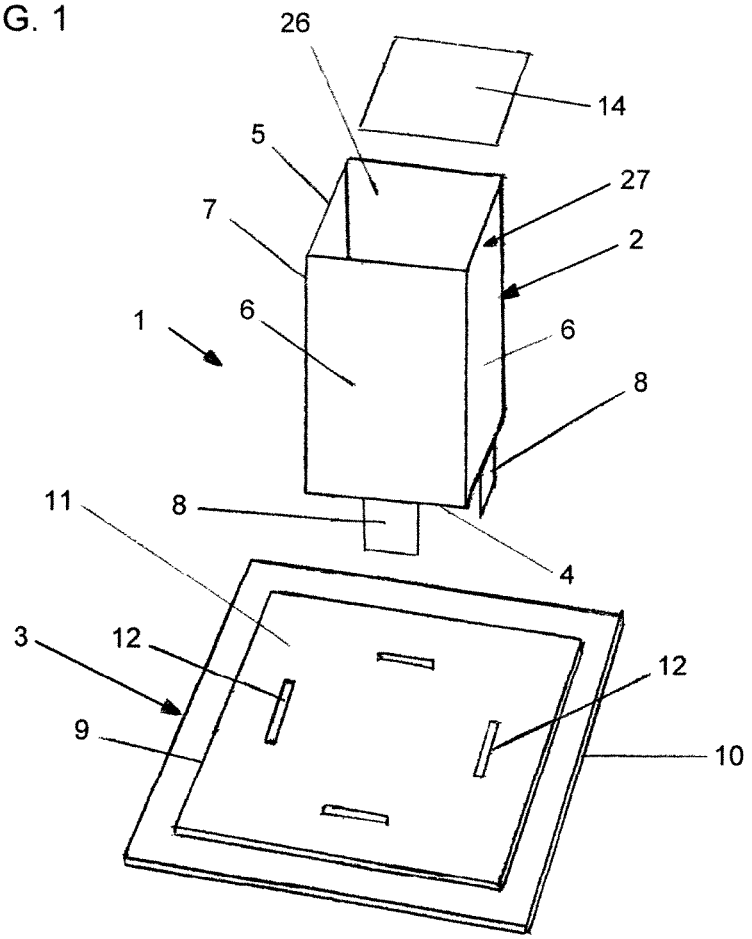
FIG. 1 is an exploded perspective schematic view of a collapsible container in an open state according to one embodiment of the invention.
Figure 2:
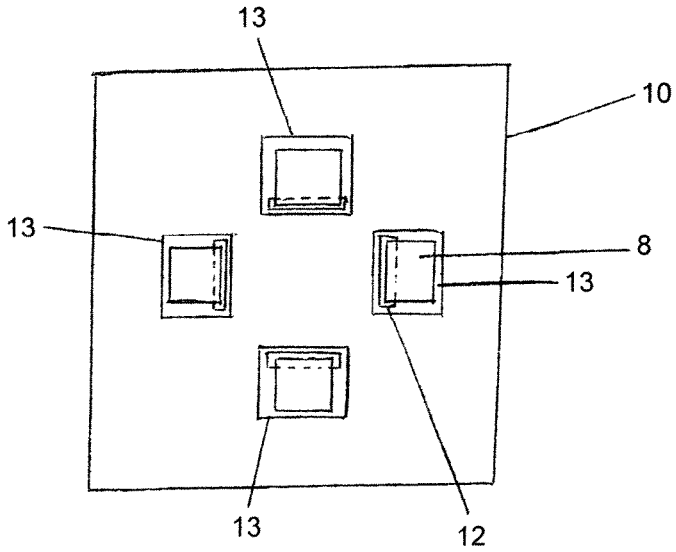
FIG. 2 is an underside schematic view of a base of the collapsible container of FIG. 1.

Referring to FIG. 1 of the accompanying drawings, a container in the form of a collapsible vase 1 is shown in its open state. The vase 1 has a sleeve 2 in which at least one item can be placed, and a square base 3.

The sleeve 2 has first and second ends 4, 5 and is a tube formed of four identical rectangular side panels 6 interconnected by joint or hinge lines 7 extending longitudinally from the first end 4 to the second end 5 and the sleeve 2 has a square cross-sectional area. Flaps or projections 8 extend from first side 4 of the sleeve 2 with each flap 8 being at the middle of the bottom of each side panel 6.

The base 3 has a generally flat horizontal upper square portion 9 placed centrally on a lower square portion 10 which extends beyond the upper square portion 9. The upper square portion 9 of the base 3 has an upper surface 11 containing slots 12 arranged to receive respective flaps 8 of the sleeve 2 when the sleeve 2 is in its opened state. The lower square portion 10 has a rectangular opening 13 corresponding to each slot 12 wherein each slot 12 is aligned with one side of the opening 13 and the opening 13 extends away from the slot 12 towards the edge of the lower square portion 10. Each opening 13 is sized to receive a respective flap 8.

When the sleeve 2 is in its open state its flaps 8 are inserted into the slots 12 in the base 3. Each flap 8 is then folded underneath the upper square portion 9 of the base 3 and the flaps 8 fit within their respective openings 13 in the lower square portion 10 of the base 3. Thus, each flap 8 is securely received by its respective slot 12 and opening 13 so that the sleeve 2 is supported in a generally upright position on the base 3.

The base 3 extends sufficiently beyond the sleeve 2 when it is attached to the base to prevent the vase 1 being readily knocked over.

A sleeve stabilising insert 14 is placed at the bottom of the sleeve 2 and is shaped so that it fits closely to the inside of the sleeve 2 when the sleeve 2 is in its open state so as to improve the stability of the sleeve 2.

In a specific example of the embodiment described above, the sleeve 2, base 3 and sleeve stabilising insert 14 comprise cardboard.

Figure 3:
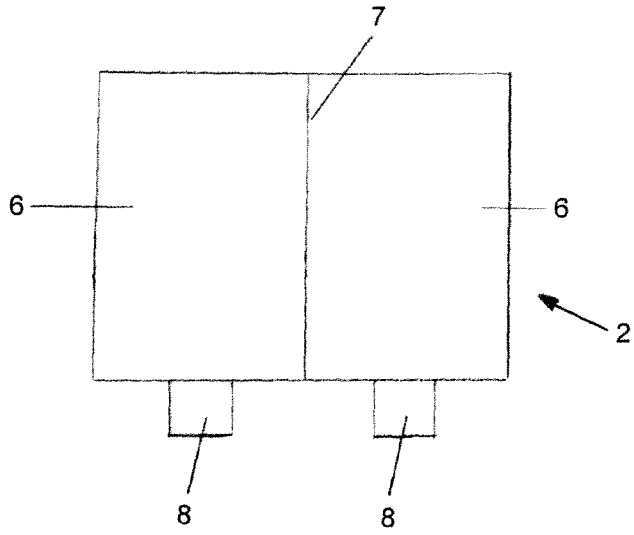
FIG. 3 is a schematic view of a sleeve of the collapsible container in a flattened state.

When the vase 1 is not in use, the sleeve stabilising insert 14 is removed. The joints 7 enable the side panels 6 to be moved relative to each other so that the sleeve 2 can be collapsed to a flattened state for storage. When the sleeve 2 is in its flattened state (see FIG. 3), each sleeve side 6 is pushed towards an adjacent sleeve side so that they are coincident.

Figure 4:
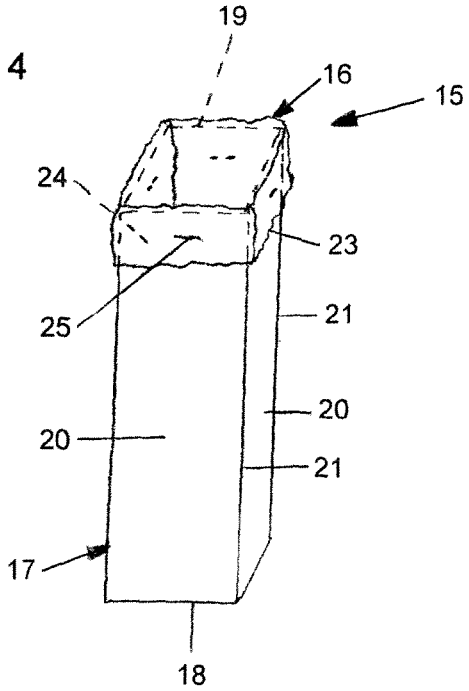
FIG. 4 is a perspective schematic view of a waterproof liner for the container.
Figure 5:
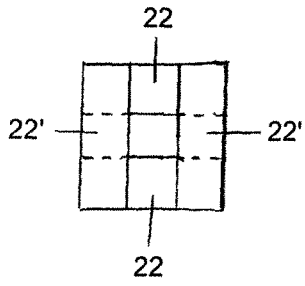
FIG. 5 is a schematic view of the bottom of the waterproof liner.

Referring to FIG. 4, a waterproof liner 15 for the vase 1 has a flexible waterproof lining means comprising a bag 16 and a supporting tube or sleeve 17. The tube 17 has first and second ends 18, 19 and four identical side panels 20 interconnected by joint or hinge lines 21 extending longitudinally from the first end 18 to the second end 19. The tube 17 has a square cross-sectional area which is slightly less than the square cross-sectional area bounded by the sleeve side panels 6 when the sleeve 2 in its open state. Rectangular flaps 22 (see FIG. 5) extend from first side 18 of the supporting sleeve 17 with each flap 22 being at the bottom of each side panel 20. The bag 16 is made from, say, a plastic, such as polyethene, and the portion 23 of the bag 16 around its entrance is folded over the second end 19 forming a rim and is fixed to an outer surface 24 of the supporting sleeve 17 by, say, staples 25. The remainder of the bag 16 hangs down inside the tube 17. The tube 17 can be in placed in a flattened state for storage by having each tube side panel 20 pushed towards an adjacent tube side panel 20 so that they are coincident.

When the vase 1 is in its open state, the waterproof liner 15 is placed in an open state and one pair of flaps 22 of the tube 17 are folded towards each other and the other pair of flaps 22' are folded towards each other and overlap the flaps 22 in their corner regions. The flaps 22' are then held to the tube 17 by adhesive tape and secure the tube in an open state. The liner 15 is then placed into the sleeve 2 so that the side panels 20 of the supporting sleeve 17 fit closely to the inside surface 26 of the side panels 6 of the sleeve 2.

Whilst a particular embodiment has been described, it will be understood that various modifications may be made without departing from the scope of the invention. In particular, the number of either of the tube sides and hinge lines of the container or the flaps and openings of the base may be varied, and the shape of the cross-sectional area of the container and of the base may be other than square.

The waterproof liner may simply comprise the bag 16 wherein the portion 23 of the bag around its entrance is folded over the second end 5 of the sleeve 2 of the vase instead, and securing means, such as finger lift adhesive, connects it to the outer surface 27 of the sleeve 2.

What is claimed is:

1. A collapsible vase, comprising:

a sleeve having first and second ends and a plurality of flaps extending from said first end, the sleeve having an open state in which at least one associated item can be placed in the sleeve and a flattened state for storage during non-use of the vase; and a base having upper and lower portions with said upper portion placed centrally on said lower portions, and the base having a periphery and a plurality of slots extending through said upper and lower portions and spaced inwardly from the periphery for securely receiving said flaps when the sleeve is in its open state, there being the same number of slots as flaps with each flap being arranged to be inserted through a respective one of said slots and folded outwardly away from the sleeve toward the base periphery, an underside of the base being formed with a respective recess formed by an opening provided in said lower portion and aligned with each of said slots and also spaced inwardly from the periphery, the opening extending away from the slot towards the base periphery, each said outwardly folded flap being sized to fit and terminate within the recess, whereby said sleeve is retained by said base in its open state in a substantially upright position.

2. The collapsible vase as claimed in claim wherein the sleeve has an even number of side panels interconnected by hinge lines extending longitudinally from said first end to said second end of the sleeve enabling the sleeve to be collapsed to the flattened state.

3. The collapsible vase as claimed in claim 2, wherein the side panels of the sleeve are substantially identical to each other.

4. The collapsible vase as claimed in claim 1, including a waterproof liner for the sleeve arranged to be held in the sleeve when the sleeve is in its open state, the waterproof liner comprising a supporting tube having first and second ends, and a plastic bag supported by the supporting tube and hanging down within the supporting tube, the sleeve has an inside, and the supporting tube has an open state in which the supporting tube is arranged to fit closely to the inside of the sleeve of the collapsible container in its opened state, and a flattened state for storage.

5. The collapsible vase as claimed in claim 4, wherein the waterproof liner is removable from the sleeve.

6. The collapsible vase as claimed in claim 1, wherein the base and the sleeve are formed of a biodegradable material.

7. The collapsible vase as claimed in claim 6, wherein the base and the sleeve are formed of cardboard.

8. The collapsible vase as claimed in claim 1, further comprising a stabilising insert dimensioned for receipt in the sleeve in the open state.

9. The collapsible vase as claimed in claim 1, wherein each opening is rectangular and each slot is aligned with one side of the opening.

* * * * *